United States Patent [19]

Boeckman et al.

[11] 4,064,719

[45] Dec. 27, 1977

[54] EMERGENCY RELEASE FOR SECURITY PANELS

[75] Inventors: Maynard A. Boeckman, Kane, Pa.; Richard M. Singer, Lafayette, Calif.

[73] Assignee: Kane Manufacturing Corporation, Kane, Pa.

[21] Appl. No.: 715,387

[22] Filed: Aug. 18, 1976

[51] Int. Cl.[2] ..... E05B 21/00

[52] U.S. Cl. ..... 70/355; 292/92

[58] Field of Search ..... 70/355, 370, 451, 372, 70/337, 340, 345–347, 353–354, 356, 409; 292/92, 93

[56] References Cited

U.S. PATENT DOCUMENTS 1,898,505 2/1933 Soemer ..... 292/92

*Primary Examiner*—Robert L. Wolfe

[57] ABSTRACT

Security panels mounted for opening or removal and having a lock mechanism that may be operated by a key from one side and an emergency release mechanism from the other side. The lock mechanism comprises a pair of slide levers disposed on opposite sides of a set of tumblers, one slide lever being engageable by a key inserted through a key opening on one side of the panel, the other slide lever being accessible from the opposite side of the panel through a slot opening. The emergency release mechanism is supplied as a subassembly which is field installed and comprises a support bracket and a bell crank pivoted from the bracket. One portion of the bell crank extends through the slot opening for engaging the other slide lever and operating the lock mechanism when contacted by a force applied in the direction for opening the panel.

3 Claims, 9 Drawing Figures

FIG. 8.
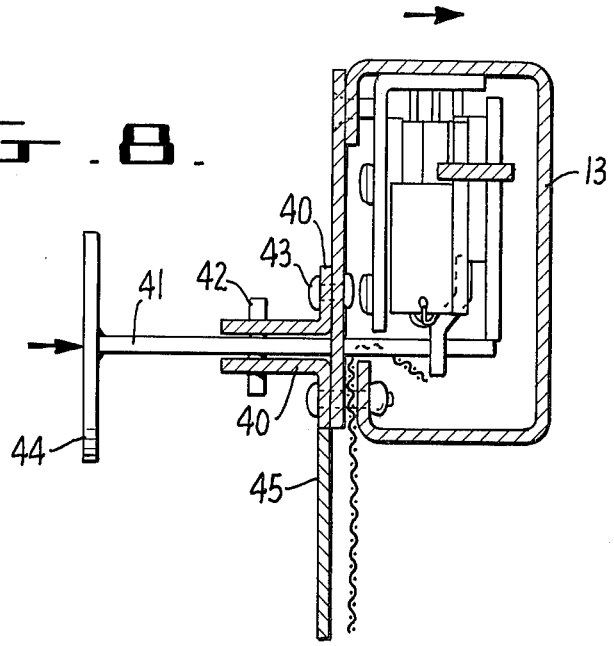
FIG. 7.
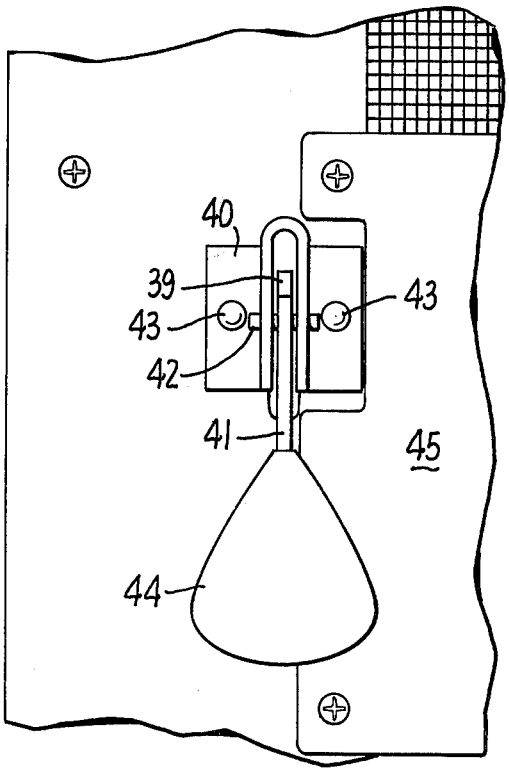
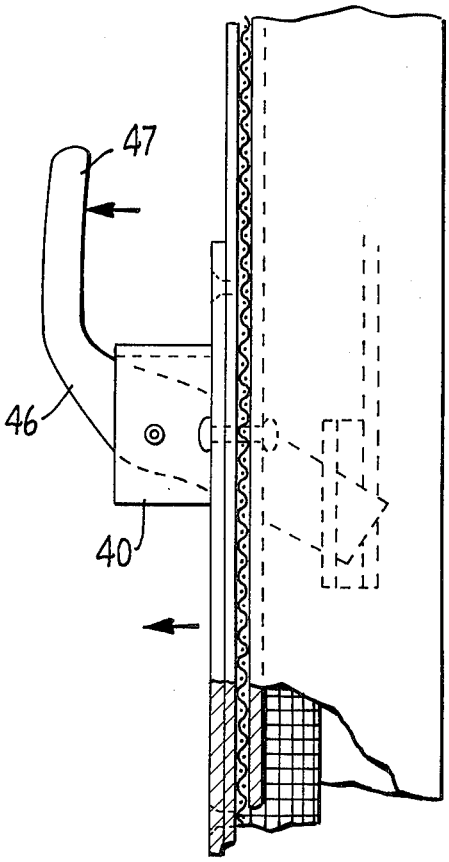
FIG. 9.

EMERGENCY RELEASE FOR SECURITY PANELS

This invention relates to security screens and panels having a key operated lock mechanism. Security screens and panels of this kind are widely used in apartments, housing projects, schools and other buildings where burglary, vandalism and forcible entry are prevalent and where a high degree of security must be maintained. Notwithstanding the importance of security, it is also important to provide means for opening the panels or screens in case of emergencey, such as a fire. The present invention is directed to this problem and teaches a unique arrangement including emergency release mechanism that is adapted to be used with an otherwise standard bit key lock construction. In brief, the invention teaches a construction for security panels that may be opened from a closed and locked position to an open position either by a key from one side or by a manual force applied from the other side in the direction for opening the panel.

One object of the present invention is to provide an improved security panel construction having a lock mechanism that is operated by a key from one side and an emergency release that bypasses the lock mechanism and which may be operated from the opposite side.

Another object is to provide security panels of the kind described including an emergency release subassembly that may be installed in the field, allowing the panels to be shipped in relatively flat cartons and stacked in a pile (without the emergency release mechanism) until the panels are installed.

Other objects of this invention will become apparent in view of the following detailed description.

Brief Description of the Drawings

In the drawings forming a part of this application and in which like parts are identified by like reference numerals throughout the same.

FIG. 7 is a front elevation of the emergency release shown in FIG. 3;

FIG. 8 is a section taken on the broken line 8—8 of FIG. 3; and

FIG. 9 is a side elevation of a second embodiment of an emergency release for a security panel that opens in the direction of a pull force.

Referring to FIGS. 1 and 2 in particular, there is illustrated a security panel 10 having a bit key lock mechanism 11 and a pair of latch assemblies 12 mounted within a frame 13. Lock mechanism 11 contains a vertically movable slide lever 14 which is actuated either indirectly by a key from one side of the frame or indirectly by a manually actuated emergency release mounted to the other side of the frame. Details of the lock mechanism are described in greater specificity below.

Figures 1, 2:
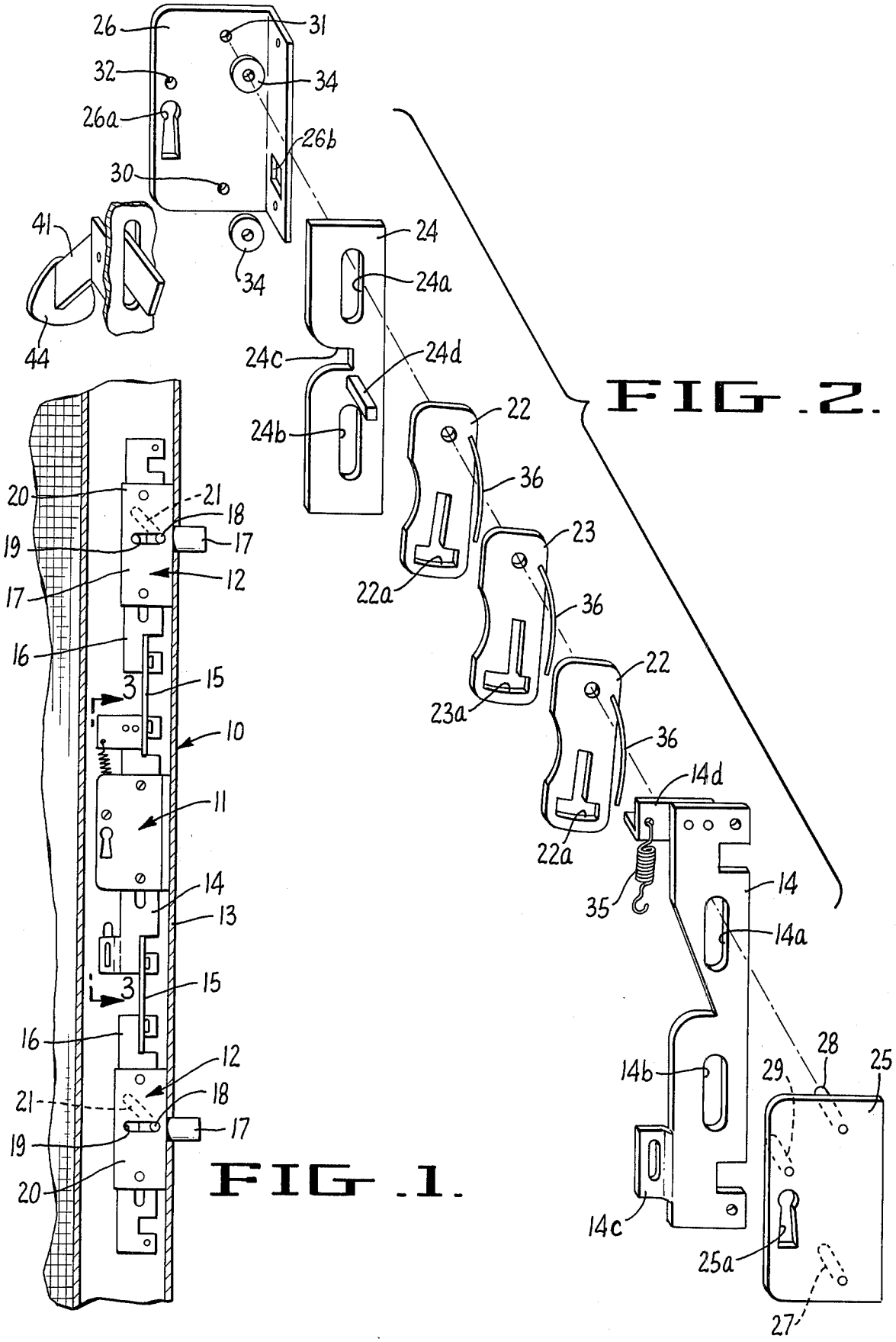
FIG. 1 is a partial section of a security screen having a bit key lock and latching mechanism as used in a preferred embodiment of the invention.
FIG. 2 is an exploded perspective view of the bit key lock.

A pair of connecting rods 15 interconnect slide lever 14 with a pair of vertical slide levers 16, one slide lever forming a part of each latch assembly 12. The latch assemblies are of a conventional design comprising a latch pin 17 mounted for lateral reciprocation and engagement with an opening formed in a subframe or jamb (not shown). A pair of guide pins 18 project from opposite sides of each latch pin 17, and each guide pin is received in a lateral slot 19 formed in a latch assembly housing 20. Pins 18 are also pivotally connected to levers 16 by links 21 (shown in dotted lines, FIG. 1). The angular relationship of slots 19 and links 21 is such that a vertical movement of the slide levers is translated to a horizontal movement of the latch pins, guide pins 18 being constrained to travel within slots 19. This construction and operation is also shown and described in U.S. Pat. No. 4,009,600.

It will be seen that a vertical movement of slide lever 14 imparts a similar vertical movement to slide levers 16 through rods 15. Thus, an upward movement of slide lever 14 produces a similar upward movement of slide levers 16, causing pins 18 to move inwardly and retract latch pins 17. With the latches retracted in this manner, the security screen or panel may be opened. Conversely, a downward movement of slide levers 14 and 16 will cause the guide pins 18 to move into the postions shown in FIG. 1, thereby moving the latch pins 17 outwardly from the latch assembly housing 20 as to engage corresponding openings in a subframe or jamb.

Lock mechanism 11 essentially comprises slide lever 14, a pair of tumblers 22, a center tumbler 23, a key operated slide lever 24 and a lock housing consisting of a mounting plate 25 and a cover plate 26. The entire lock assembly is held together and supported by three cylindrical posts 27, 28 and 29. One end of each post is attached to plate 25 as by means of rivets or screws and the opposite end of each post is adapted to be received in openings 30, 31 and 32 formed in cover plate 26. In the preferred construction, cylindrical posts 27, 28 and 29 are slightly larger in diameter than the openings 30, 31 and 32, although the ends of the post are of a reduced diameter to be received within the openings. Thus, each post provides a shoulder which serves to accurately space cover 26 from mounting plate 25. In addition, each post is internally threaded to receive a machine screw 33 (shown in FIG. 3) which holds the lock assembly together. A pair of brass washers 34 mounted on posts 27 and 28 separate and space slide 24 from cover 26.

Figure 4:
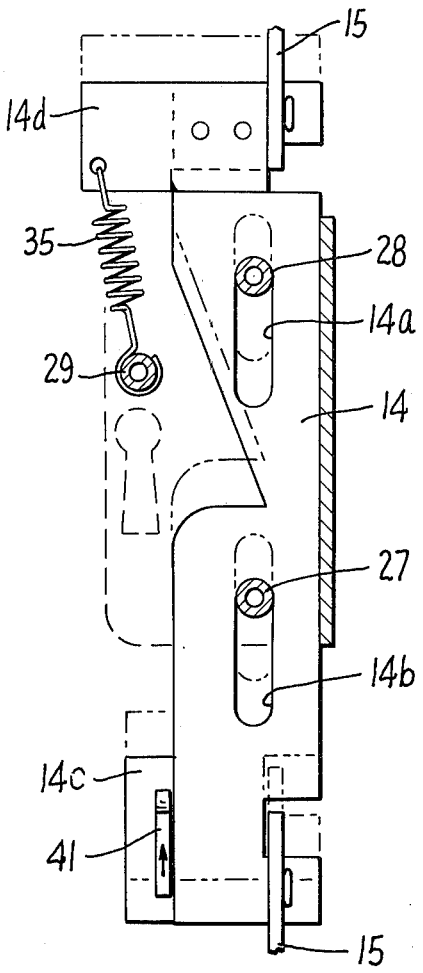
FIG. 4 is a section taken on line 4—4 of FIG. 3.

Slide lever 14 is formed with a pair of slotted openings 14*a* and 14*b* which support the lever for reciprocation upon posts 27 and 28. A slotted ear 14*c* projects to one side from the lower end of the lever, and an angle bar 14*d* projects to the same side from the upper end. The function and purpose of slotted ear 14*c* and angle bar 14*d* will be described below. A return spring 35 biases the slide lever 14 to a lowermost position within the lock mechanism, as shown in FIG. 4.

Tumblers 22 and 23 are each formed from a flat blank having an opening at one end for mounting the tumblers on post 28. The tumblers are also formed with T-shaped slots 22*a*, 23*a*, the latter slot being located off-center or to one side as shown in FIG. 2. A leaf spring 36 is provided on each tumbler, one end of each leaf spring being wedged or otherwise secured in a slot formed in the peripheral edge of the tumbler. The opposite end of each spring 36 is received in a slot 26*b* formed in cover plate 26.

Figure 6:
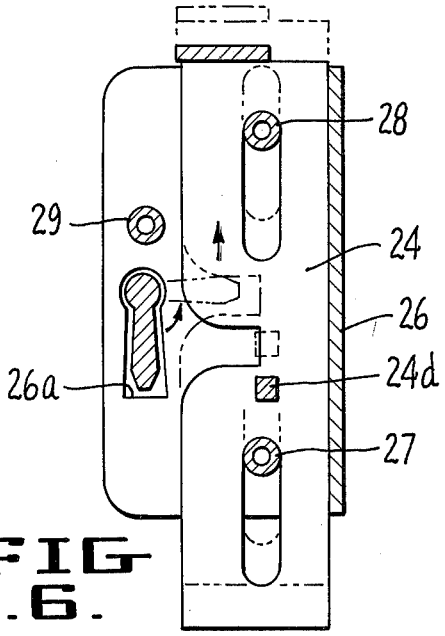
FIG. 6 is a section of the lock taken on line 6—6 of FIG. 3.

Slide lever 24 consists of a generally rectangular flat plate formed with two vertical slots 24*a* 24*b* which permit the plate to be slidably mounted on posts 27 and 28. The plate is also formed with a lateral key engaging slot or indentation 24c and a control bar 24d. The outer edges of slot 24c are curved to provide camming surfaces which are contacted by a lock key to produce a sliding movement of the plate as shown in FIG. 6. Such movement can occur, however, only when control bar 24d is an alignment with the leg of each T-shaped slot 22a, 23a.

Figure 3:
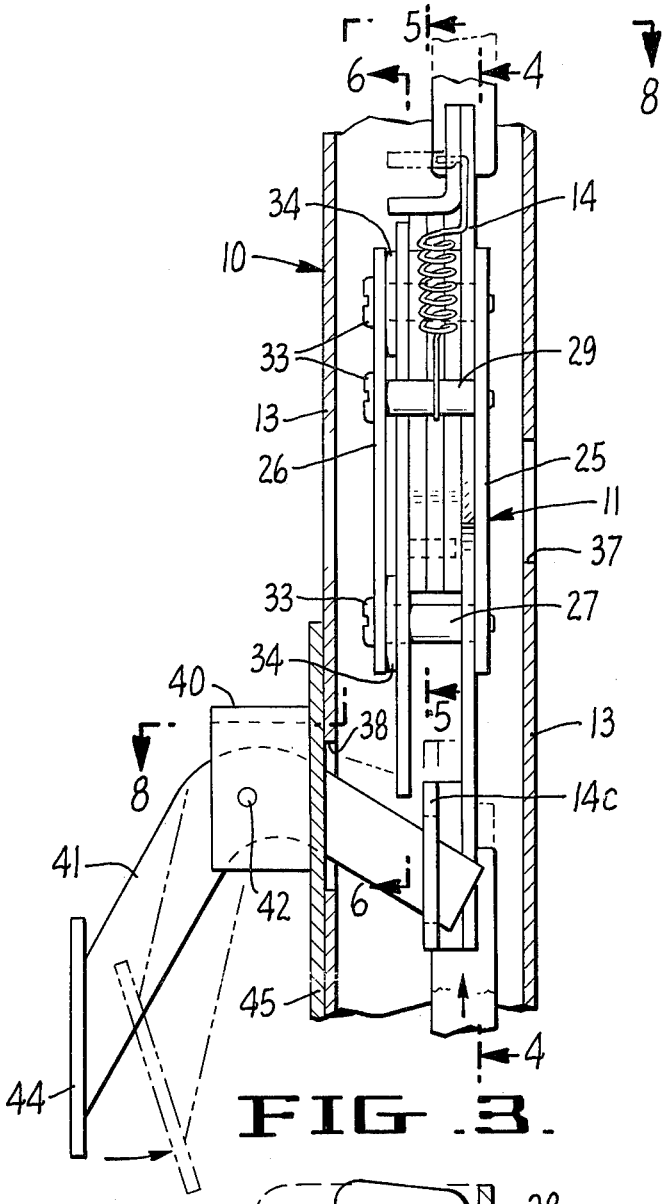
FIG. 3 is a section taken on line 3—3 of FIG. 1.

Mounting plate 25 and cover plate 26 are formed with key openings 25a and 26a, respectively, and it will be noted that tumbler 23 is centrally positioned relative to the outer surface of both plate 25 and cover 26. Thus, lock mechanism 11 is designed to be operated by the same key from either side of the lock. However, with the present invention, only one key opening is actually exposed or accessible for key operation. Referring to FIG. 3, a key opening 37 is formed in frame 13, said opening being in alignment with the key opening 25a of mounting plate 25.

The present invention specifically contemplates, however, the further provision of an elongate slot or opening 38 formed in frame 13. This slot provides access to slide lever 14 for manual operation. In addition, an emergency release subassembly is provided comprising a support bracket 40 and a bell crank lever 41 pivoted from the bracket upon a horizontal roll pin 42. The subassembly as a whole may be field installed by means of rivets 43 or machine screws. One end of lever 41 extends through slot opening 38 and engages the slotted ear 14c provided on slide lever 14. The opposite end of lever 41 carries a strike plate 44 for operating the lever by a push force. Where the security panel 10 comprises a wire cloth which is located in the vicinity of the emergency release mechanism, a guard plate 45 is provided as shown in FIG. 7.

Figure 5:
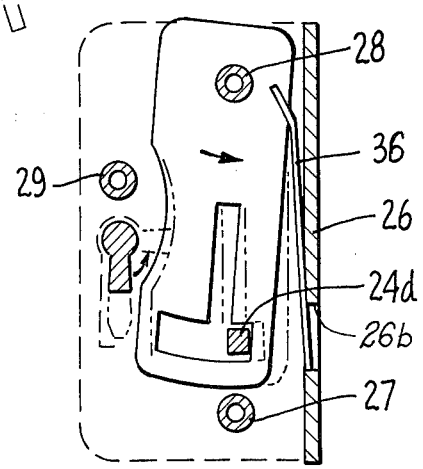
FIG. 5 is a section of the lock taken on line 5—5 of FIG. 3.

The operation of the lock mechanism itself is essentially conventional. In that regard, it will be understood that slide plate 24 is reciprocally actuated by a key inserted into the lock mechanism through openings 37 and 25a. Initial rotation of the key causes the appropriate portions of the key blade to contact tumblers 22, 23, pivoting them against the spring bias of leaf springs 36 (as shown in FIG. 5) until the T-shaped slots of each tumbler are in vertical alignment with control bar 24d. Further rotation of the key causes the key blade to engage the upper camming surface of slot 24c and move the slide member vertically. At the same time, the end of slide lever 24 engages the angle plate 14d of slide bar 14 and imparts a corresponding vertical movement to the slide bar against the resilient force of return spring 35. And, as previously stated, actuation of slide lever 14 operates latch assemblies 12 through connecting rods 15.

Slide bar 24 and the operation of tumblers 22 and 23 are bypassed when the emergency release is operated. Referring to FIG. 3 in particular, a push force applied against strike plate 44 results in a pivotal movement of lever 41, which in turn imparts a translatory sliding movement to lever 14 and actuates latch mechanism 12.

It is contemplated by this invention that the emergency release mechanism be compatible with the mounting of the panel assembly. Therefore, when the security panel is mounted for opening or removal in a direction away from the emergency release, a release lever of the type shown in FIGS. 2, 3, 7 and 8 is preferred, since a continuing thrust against the strike plate actuates slide lever 14 for operating latch mechanisms 12 and also move the panel. It is further contemplated, however, that where the panel is designed to open in the direction of the emergency release, the emergency release lever is best constructed as shown in FIG. 9. In this embodiment, a pivoted crank lever 46 is provided having a handle 47 which is engageable by A "pull" in the general direction for opening the panel.

Security panels constructed in accordance with the present invention provide a unique form of emergency release which is easily installed in the field on frames which may be stacked for convenience of handling and shipping. Although a preferred embodiment of the invention has been illustrated and described, various modifications and changes may be resorted to without departing from the spirit of the invention or the scope of the appended claims, and each of such changes and modifications is contemplated.

What is claimed is:

1. A security panel having a emergency release, said panel being mounted for opening or removal in one direction only and comprising: a frame having a key opening formed through one side and a slot opening formed through the opposite side, said openings being out of axial alignment; lock mechanism mounted in said frame, said lock mechanism comprising a pair of slide levers disposed on opposite sides of a set of tumblers, one slide lever being engageable by a key inserted through the key opening, the other slide lever being accessible from the opposite side of said frame through the slot opening; and means responsive to sliding actuation of said pair of slide levers for securing or releasing said frame to or from a support; and an emergency release subassembly comprising a support bracket and a bell crank pivoted from said bracket, one end of said crank being receivable through the slot opening and engageable with said other slide lever; whereby the security panel may be opened from a closed and locked position to an open position either by a key from one side of the panel or by applying a force to the bell crank from the opposite side of the panel.

2. The emergency release of claim 1, said key opening being located on the side facing the direction for opening the panel, said pivoted crank having a strike plate engageable by a thrust in the general direction for opening said panel.

3. The emergency release of claim 1, said key opening being located on the side facing away from the direction for opening the panel, said pivoted crank having a handle engageable by a pull in the general direction for opening said panel.

* * * * *

UNITED STATES PATENT OFFICE

CERTIFICATE OF CORRECTION

Patent No. 4,064,719 Dated December 27, 1977

Inventor(s) Maynard A. Boeckman and Richard M. Singer

It is certified that error appears in the above-identified patent and that said Letters Patent are hereby corrected as shown below:

Column 1, line 11, "emergencey" should be "emergency".

Column 1, lines 62,63, "indirectly" should be "directly".

Column 3, line 8, "is an" should be "is in an".

Column 4, line 2, "mechanism" should be "mechanisms".

Column 4, line 11 "move" should be "moves".

Column 4, line 16, "A" should be "a".

Column 4, line 29, "a" should be "an".

Signed and Sealed this

Twenty-first Day of March 1978

[SEAL]

Attest:

RUTH C. MASON
Attesting Officer

LUTRELLE F. PARKER
Acting Commissioner of Patents and Trademarks